US009821323B2

(12) United States Patent
Ikushima

(10) Patent No.: US 9,821,323 B2
(45) Date of Patent: Nov. 21, 2017

(54) DROPLET FORMING DEVICE AND DROPLET FORMING METHOD

(71) Applicant: MUSASHI ENGINEERING, INC., Mitaka-shi, Tokyo (JP)

(72) Inventor: Kazumasa Ikushima, Mitaka (JP)

(73) Assignee: MUSASHI ENGINEERING, INC., Tokyo (JP)

( * ) Notice: Subject to any disclaimer, the term of this patent is extended or adjusted under 35 U.S.C. 154(b) by 174 days.

(21) Appl. No.: 14/374,726

(22) PCT Filed: Jan. 25, 2013

(86) PCT No.: PCT/JP2013/051587
§ 371 (c)(1),
(2) Date: Jul. 25, 2014

(87) PCT Pub. No.: WO2013/111855
PCT Pub. Date: Aug. 1, 2013

(65) Prior Publication Data

US 2014/0346253 A1 Nov. 27, 2014

(30) Foreign Application Priority Data

Jan. 27, 2012 (JP) ..... 2012-015736

(51) Int. Cl.
*F02M 51/06* (2006.01)
*B05B 1/02* (2006.01)
(Continued)

(52) U.S. Cl.
CPC ..... *B05B 1/02* (2013.01); *B05C 5/0212* (2013.01); *B05C 5/0225* (2013.01);
(Continued)

(58) Field of Classification Search
CPC ..... F02M 51/061; F02M 51/0628; F02M 51/0614; F02M 51/0635; F02M 51/0607;
(Continued)

(56) References Cited

U.S. PATENT DOCUMENTS 4,978,074 A * 12/1990 Weinand ..... F02M 51/066 239/585.3
5,218,999 A * 6/1993 Tanimoto ..... F16K 31/0627 137/625.65
(Continued)

FOREIGN PATENT DOCUMENTS

CN 1231621 A 10/1999
GB 2289319 A 11/1995
(Continued)

OTHER PUBLICATIONS

International Search Report dated Apr. 9, 2013, issued in corresponding application No. PCT/JP2013/051587.
(Continued)

*Primary Examiner* — Arthur O Hall
*Assistant Examiner* — Tuongminh Pham
(74) *Attorney, Agent, or Firm* — Westerman, Hattori, Daniels & Adrian, LLP

(57) ABSTRACT

A droplet forming device (1) for discharging a droplet in a flying fashion from a nozzle (32), the device includes a liquid chamber (29) that is communicated with the nozzle (32) and is supplied with a liquid material (37), a plunger rod (6) having a tip (34) that is moved to advance and retreat within the liquid chamber (29), a spring (8) that applies a biasing force to the plunger rod (6), a pressurization chamber (11) that is supplied with a pressurized gas (10) acting to retreat the plunger rod (6), a pressure source (15) that supplies the pressurized gas (10) to the pressurization chamber (11), and a controller (45). The droplet forming device
(Continued)

(1) further includes a magnetic field generating mechanism (21, 22) that generates an attraction force to act in an advancing direction when the plunger rod (6) approaches a most advanced position thereof.

20 Claims, 7 Drawing Sheets

(51) Int. Cl.
*F04B 17/04* (2006.01)
*B05C 5/02* (2006.01)

(52) U.S. Cl.
CPC ..... *B05C 5/0237* (2013.01); *F02M 51/061* (2013.01); *F04B 17/04* (2013.01); *F04B 17/044* (2013.01)

(58) Field of Classification Search
CPC ..... F02M 51/0603; F02M 51/0653; F02M 51/0671; B05B 1/02
USPC ..... 239/583, 584, 585.1, 585.3–585.5; 251/14, 129.03
See application file for complete search history.

(56) References Cited

U.S. PATENT DOCUMENTS

| | | | | |
|---|---|---|---|---|
| 5,405,050 | A | 4/1995 | Walsh | |
| 5,738,728 | A | 4/1998 | Tisone | |
| 5,741,554 | A | 4/1998 | Tisone | |
| 5,743,960 | A | 4/1998 | Tisone | |
| 5,765,513 | A * | 6/1998 | Diehl | F01L 9/04 123/90.11 |
| 5,916,524 | A | 6/1999 | Tisone | |
| 6,576,295 | B2 | 6/2003 | Tisone | |
| RE38,281 | E | 10/2003 | Tisone | |
| 7,541,068 | B2 | 6/2009 | Tisone | |
| 2002/0001675 | A1 | 1/2002 | Tisone | |
| 2003/0161939 | A1 | 8/2003 | Kweon et al. | |
| 2004/0052955 | A1 | 3/2004 | Tisone | |
| 2006/0157517 | A1 | 7/2006 | Fiske et al. | |
| 2006/0292304 | A1 | 12/2006 | Tisone | |
| 2010/0156970 | A1 * | 6/2010 | Ikushima | B05B 12/06 347/8 |
| 2010/0294810 | A1 | 11/2010 | Ikushima | |
| 2011/0253918 | A1 * | 10/2011 | Rampen | F04B 7/0076 251/65 |
| 2013/0233891 | A1 | 9/2013 | Ikushima | |

FOREIGN PATENT DOCUMENTS

| | | | |
|---|---|---|---|
| JP | 55-137262 | U | 9/1980 |
| JP | H07-185427 | A | 7/1995 |
| JP | 11-057594 | A | 3/1999 |
| JP | 2003-280015 | A | 10/2003 |
| JP | 2004-028312 | A | 1/2004 |
| JP | 3886211 | B2 | 2/2007 |
| JP | 4663894 | B2 | 4/2011 |
| WO | 2008/126373 | A1 | 10/2008 |

OTHER PUBLICATIONS

Office Action dated Mar. 16, 2016, issued in counterpart Taiwanese Patent Application No. 102103059. (7 pages).
Supplementary European Search Report dated Apr. 12, 2016, issued in counterpart European Patent Application No. 13740917. (2 pages).
Office Action dated Feb. 2, 2017, issued in counterpart Japanese Application No. 2016-076950. (4 pages).

* cited by examiner

[Fig.1]
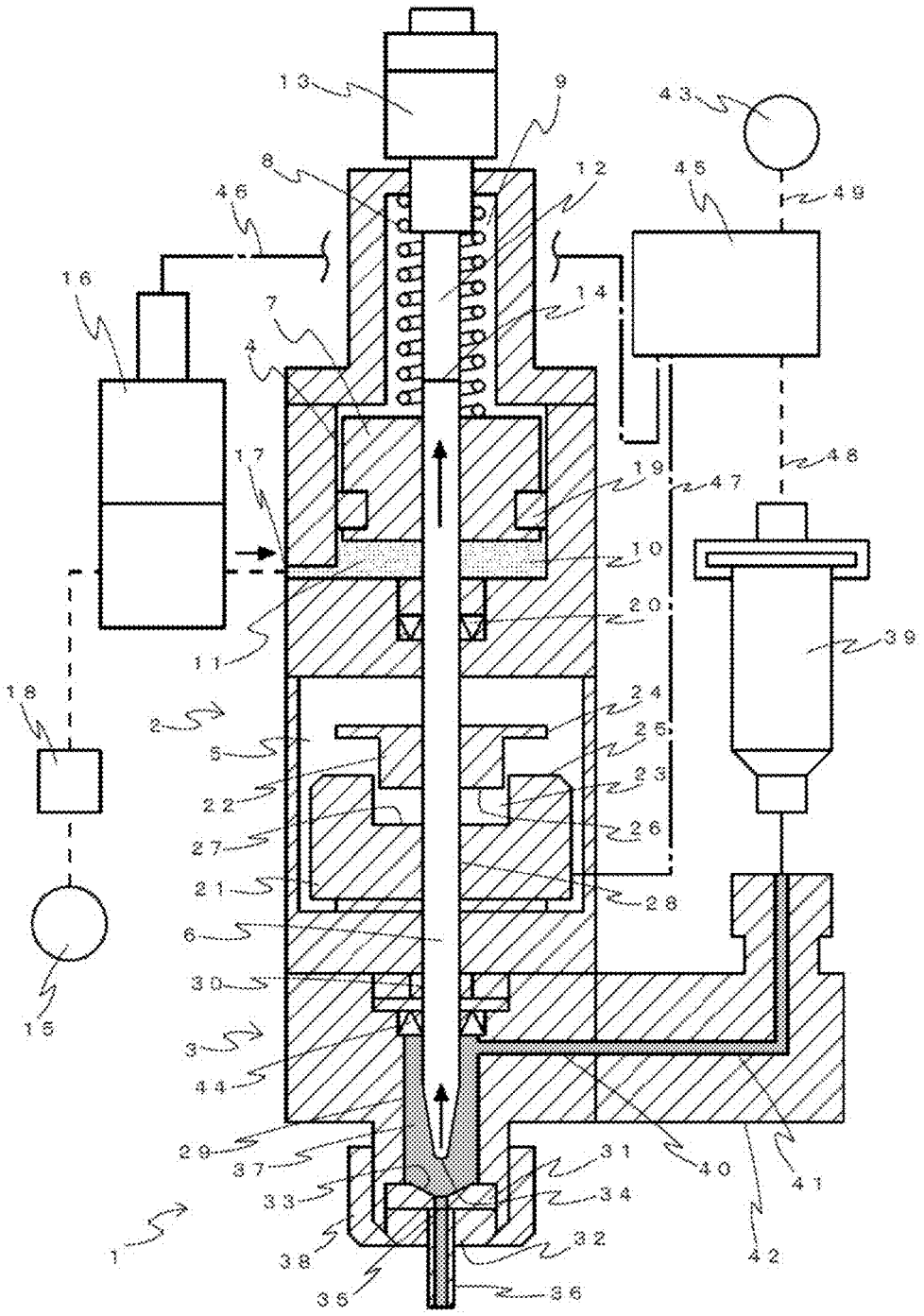

[Fig.2]
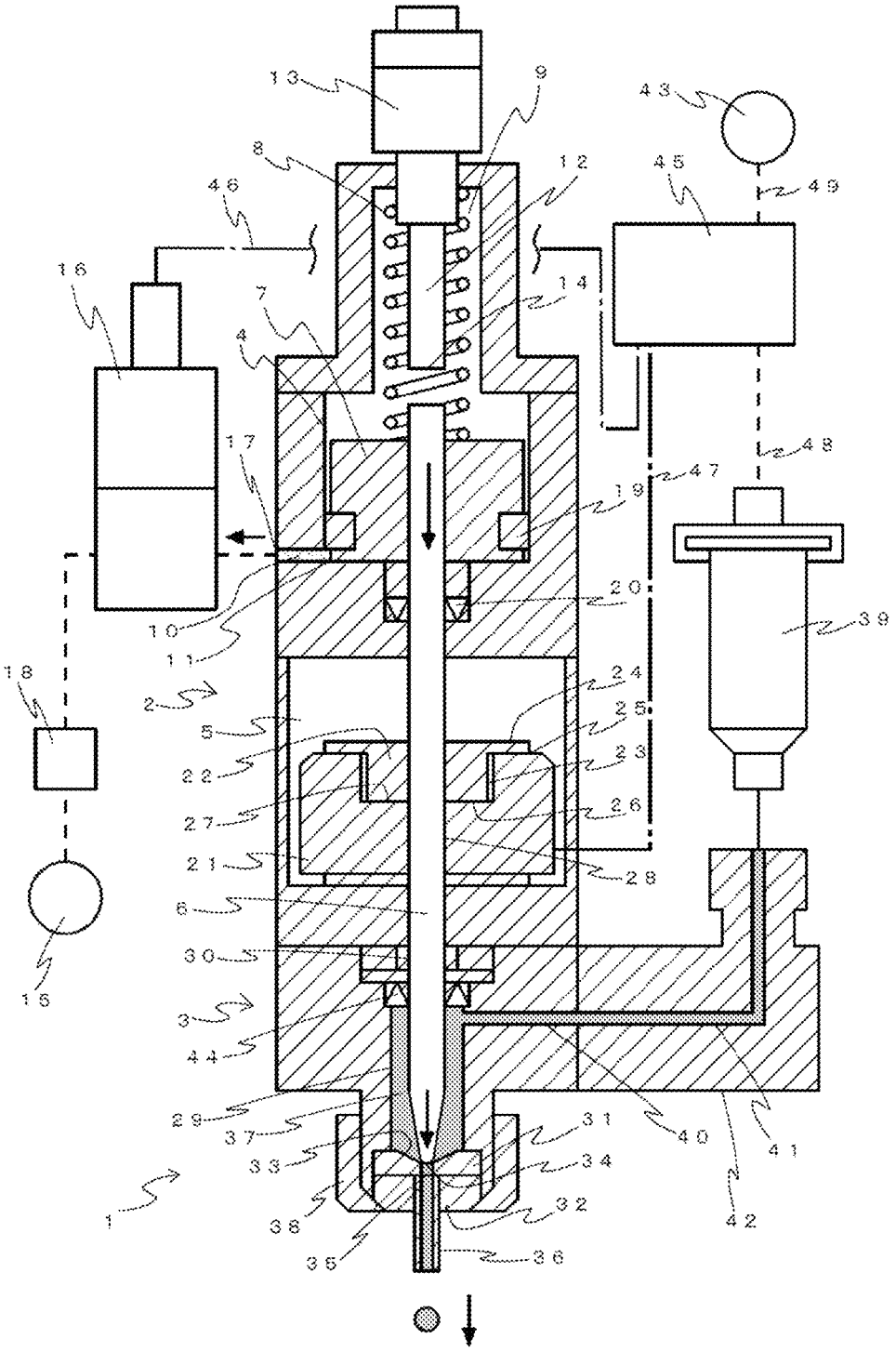

[Fig.3]
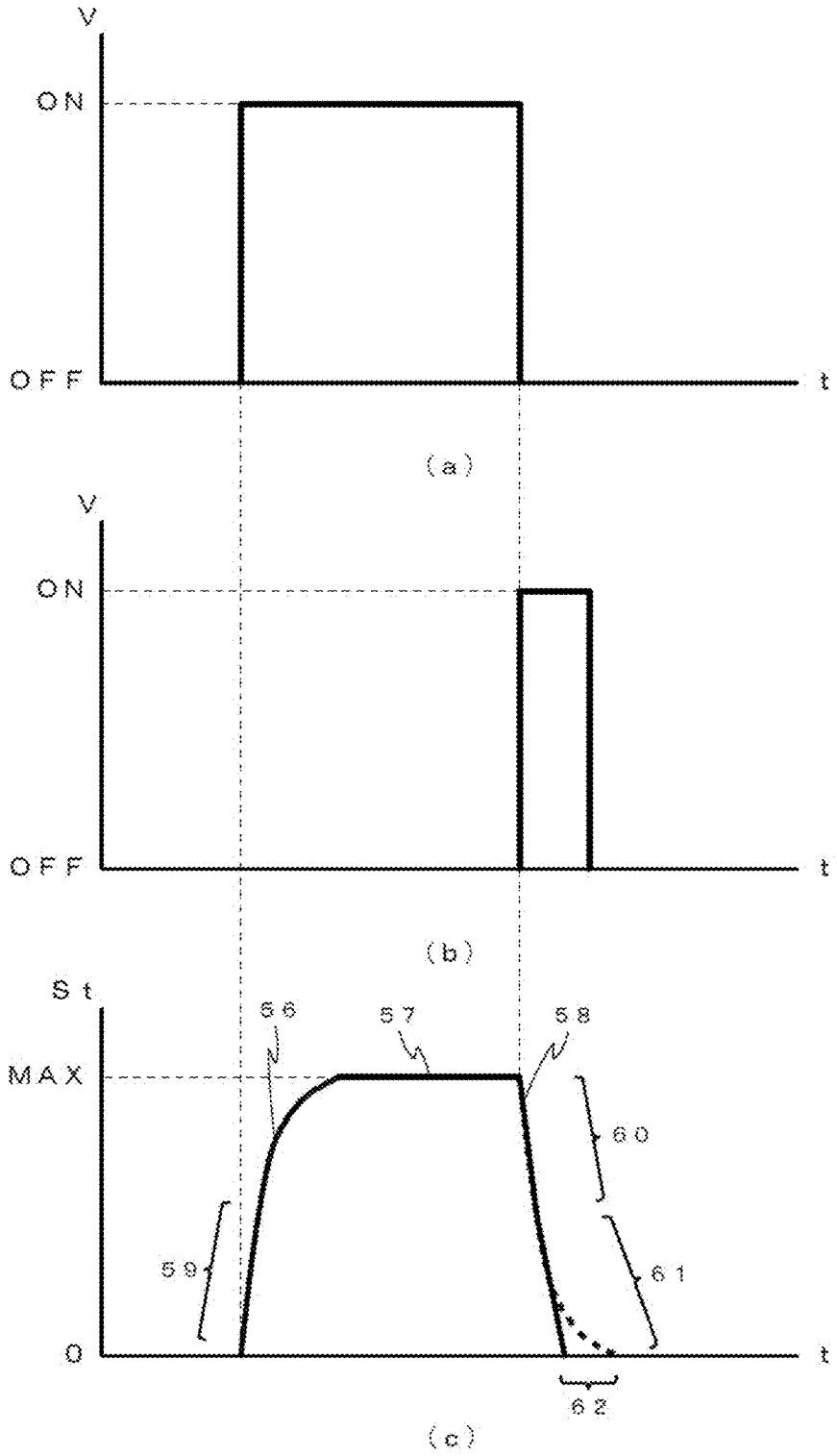

[Fig.4]
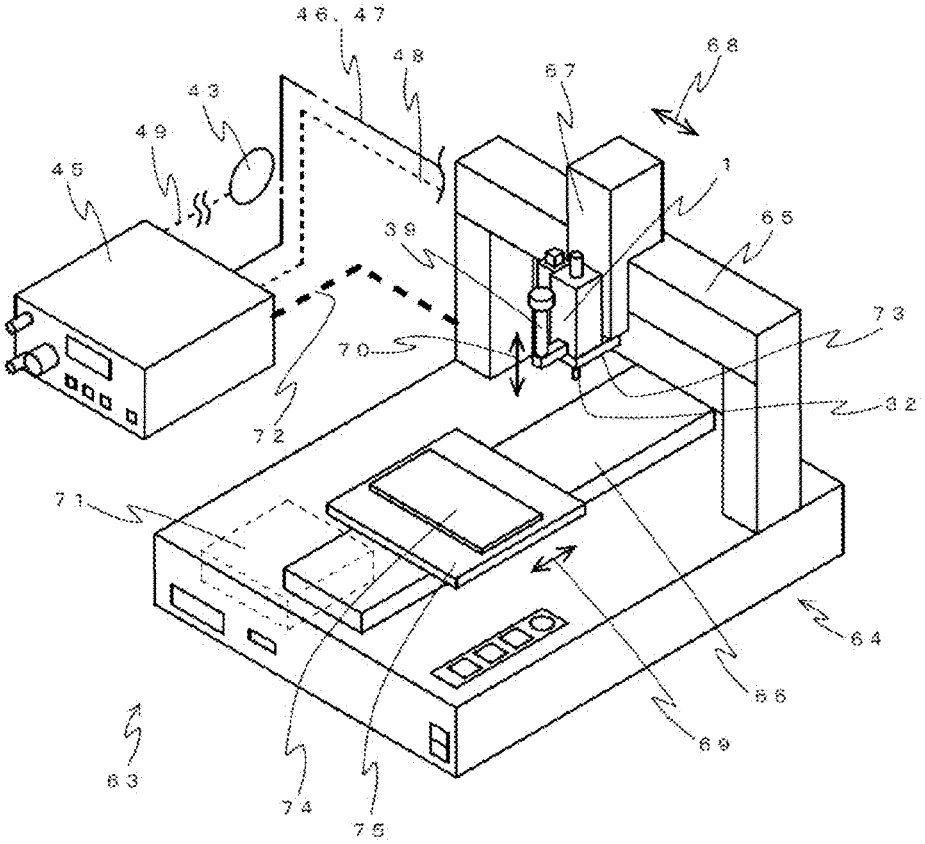

[Fig.5]
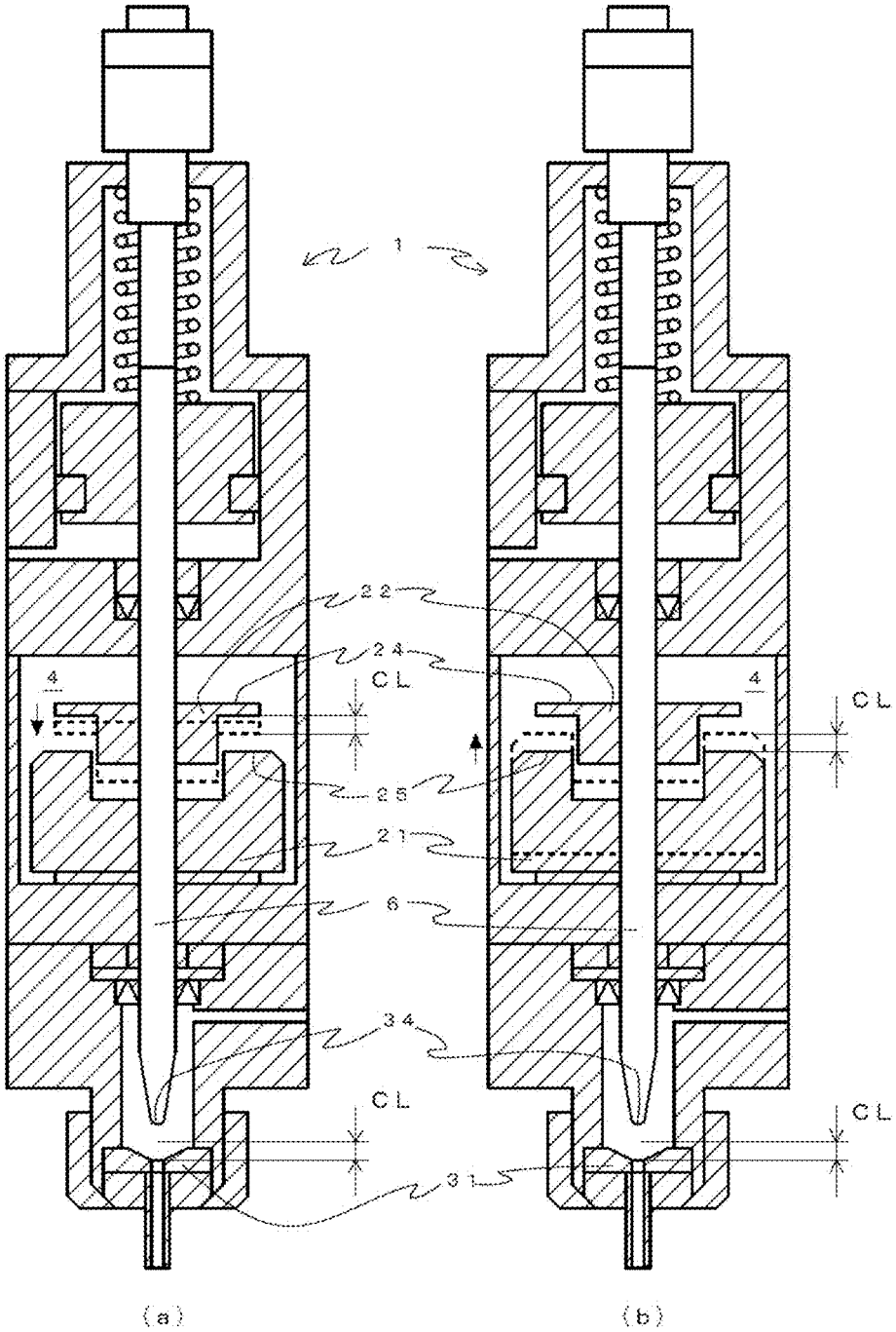

[Fig.6]
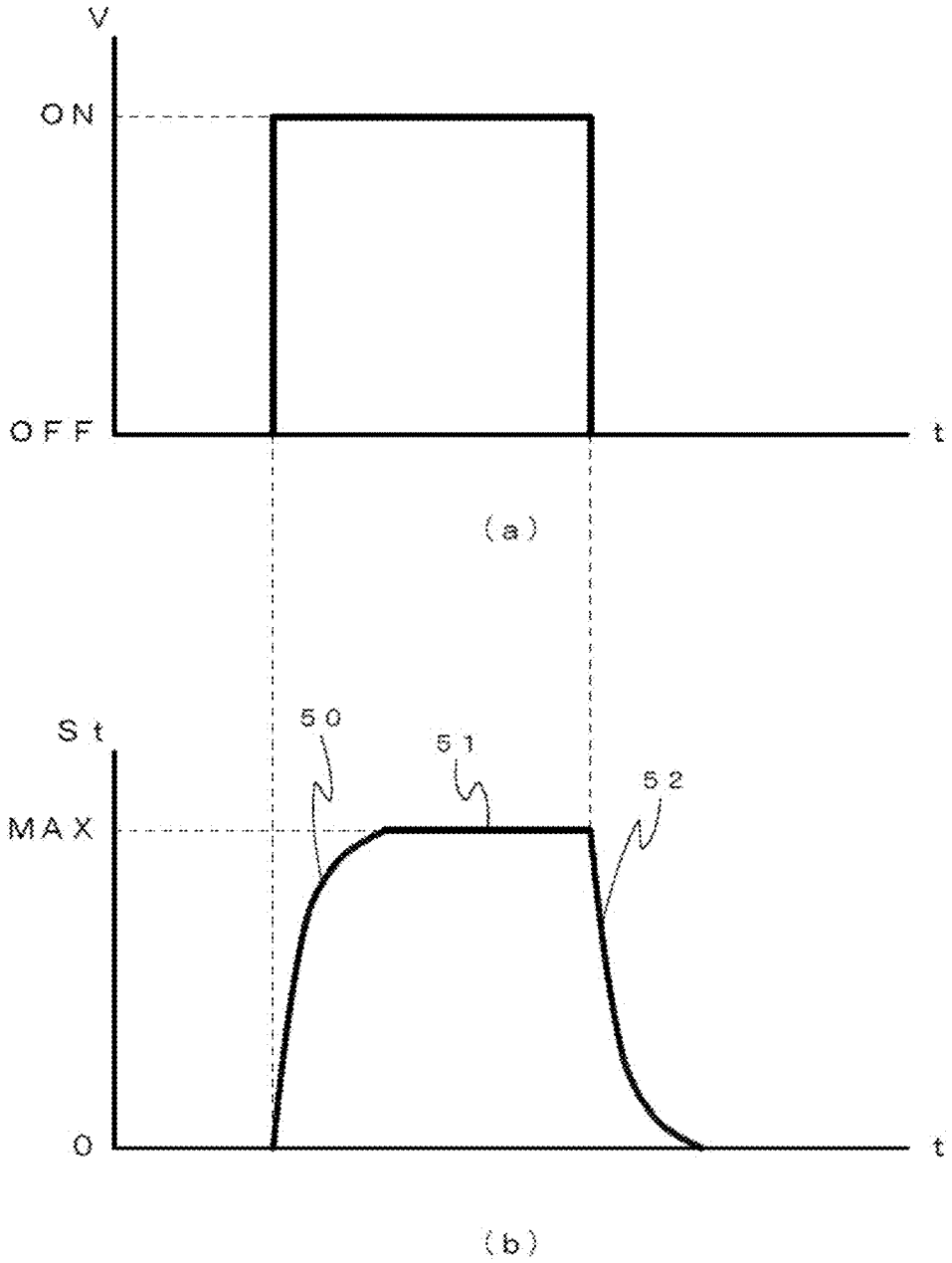

[Fig.7]
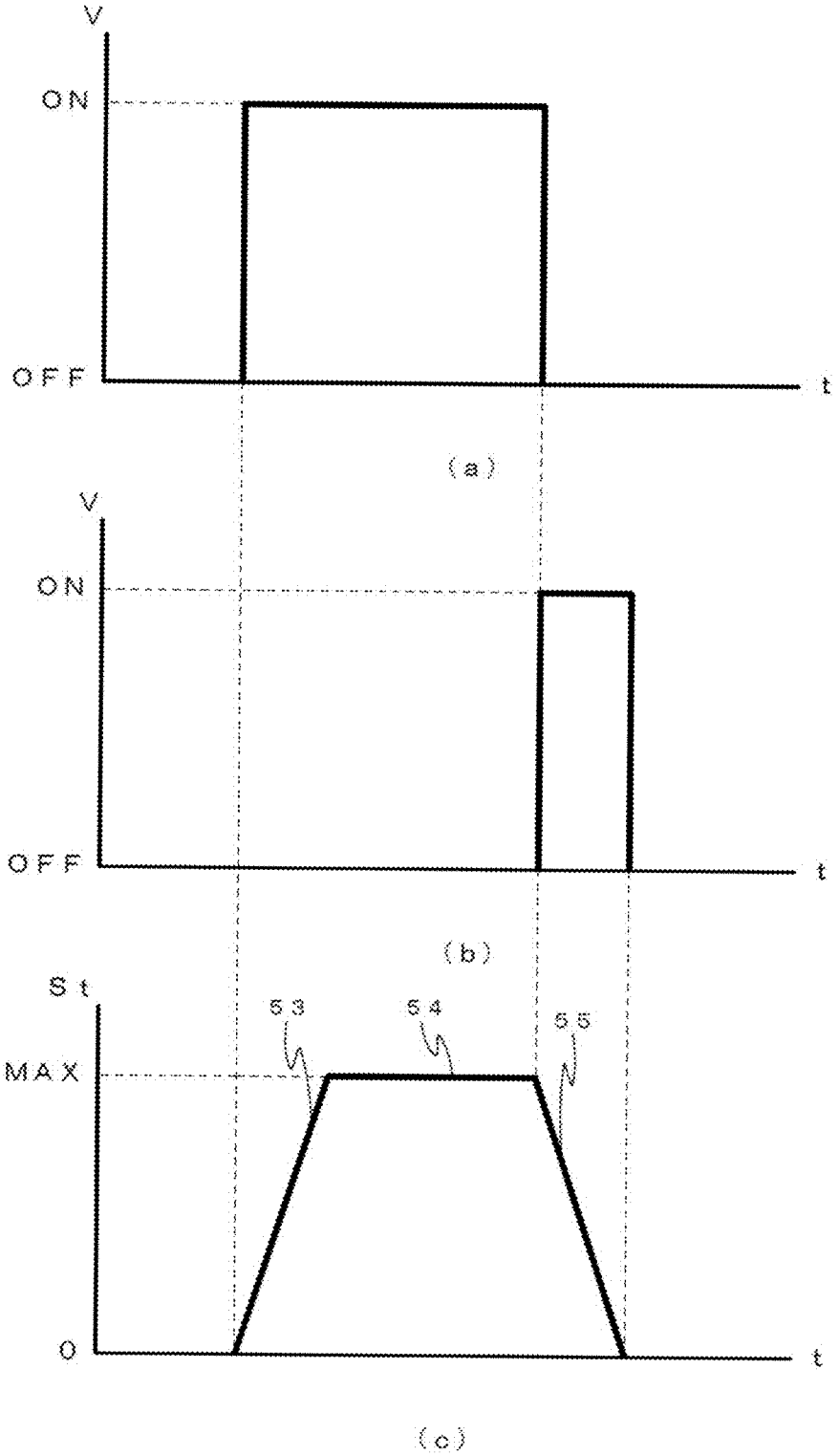

DROPLET FORMING DEVICE AND DROPLET FORMING METHOD

TECHNICAL FIELD

The present invention relates to a device and a method for discharging a liquid material in the form of a droplet. More particularly, the present invention relates to a device and a method of, for example, striking a valve body against a valve seat to separate the liquid material from a tip such that the liquid material is discharged as a droplet flying from the tip.

BACKGROUND ART

As one type of device for discharging a liquid material in the form of a droplet, there is known a device of striking a valve body against a valve seat to separate the liquid material from a distal end of a discharge port such that the liquid material is discharged as a droplet flying from the distal end. In that type of device, the valve body is driven in various manners.

For example, Patent Document 1 discloses a device of the type ascending a valve body by air pressure, and descending the valve body by a repulsive force of a spring. In the device of Patent Document 1, a piston attached to the valve body is slidably fitted in a driving chamber, and a spring (compressed spring) is disposed above the piston. An air chamber is formed under the piston and is connected to a compressed air source through a selector valve. A discharge chamber is formed under the driving chamber with interposition of a wall therebetween, the wall having a penetration hole through which the valve body is inserted. The valve body is movable in the discharge chamber, and a discharge port is formed in a lower surface of the discharge chamber. A liquid material is supplied under adjusted pressure to the discharge chamber from a reservoir. When the selector valve is operated to supply the compressed air to the air chamber, the piston is caused to ascend while contracting the spring, thereby opening the discharge port that has been closed by the valve body. Because the liquid material is in a state under pressure, the liquid material is ejected to the outside from a tip when the discharge port is opened. When the selector valve is operated to release the compressed air, which has been supplied to the air chamber, to the atmosphere, the valve body is caused to descend by the repulsive force of the contracted spring and to abut against an upper portion of the discharge port, which portion forms a valve seat, whereupon the valve body is abruptly stopped in a state closing the discharge port. As a result, the liquid material ejected from the distal end of the discharge port is discharged in the form of a droplet.

As another example, Patent Document 2 discloses a device of the type ascending a valve body by an electrical solenoid and descending the valve body by another (separate) electrical solenoid. In the device of Patent Document 2, a jetting member is disposed within a main container including a nozzle through which an adhesive is to be ejected, and two electrical solenoids for driving the jetting member are arranged coaxially with the jetting member at a position above the main container. A flange is formed on a core rod of second one of the two electrical solenoids, which is located at an upper position, and a spring for always biasing the jetting member toward an ejection inhibit position is engaged with the flange. When the first electrical solenoid is operated, the jetting member is moved from the ejection inhibit position to an ejection enable position. Because the adhesive is pressurized by compressed air, the adhesive is ejected from the nozzle, and an adhesive pool is formed at a nozzle tip. Then, when the second electrical solenoid is operated, the jetting member is moved from the ejection enable position to the ejection inhibit position while a biasing force of the spring is applied additionally, thereby causing a lower end portion of the jetting member to abut against a bottom surface of the main container. As a result, the adhesive pool formed at the nozzle tip is jetted.

LIST OF PRIOR-ART DOCUMENTS

Patent Documents

Patent Document 1: Japanese Patent No. 4663894
Patent Document 2: Japanese Patent No. 3886211

SUMMARY OF THE INVENTION

Problems to be Solved by the Invention

Generally, a repulsive force of a spring (compressed spring) gradually weakens in a process in which the spring extends from a compressed state to a natural state. In the air spring type device of Patent Document 1, the spring repulsive force weakens and a force acting on the valve body to close the valve seat also weakens in some cases when the valve body (plunger rod) descends and approaches the end of a stroke. Particularly, in the case of handling a liquid material with high viscosity, a sufficient force acting on the valve body to close the valve seat cannot be obtained and the liquid material is discharged without being separated from the distal end of the discharge port in some cases in the air spring type device. When a stronger spring is used to increase the above-mentioned force with the view of solving such a problem, not only the diameter and the length of the spring itself, but also the flow rate of air required to compress the spring are increased, thus leading to a fear that the piston diameter and the size of the selector valve for driving the piston are increased and that the device size is increased.

In consideration of the above-described state of the art, an object of the present invention is provide a droplet forming device and method, which can exert a constant strong advancing force on a valve body (plunger rod) without increasing the device size, and which cause no influences on a retreat time of the valve body.

Means for Solving the Problems

The inventor has accomplished the present invention based on the finding that combined use of a magnetic field generating mechanism is effective in solving the problem that the biasing force applied to the valve body (plunger rod) from a spring weakens when the valve body advances and approaches the end of its stroke. Thus, the present invention is constituted by the following technical means.

According to a first invention, there is provided a droplet forming device for discharging a droplet in a flying fashion from a nozzle, the device comprising a liquid chamber that is communicated with the nozzle and is supplied with a liquid material, a plunger rod having a tip that is moved to advance and retreat within the liquid chamber, a spring that applies a biasing force to the plunger rod, a pressurization chamber that is supplied with a pressurized gas acting to retreat the plunger rod, a pressure source that supplies the pressurized gas to the pressurization chamber, and a controller, wherein the droplet forming device further comprises a magnetic field generating mechanism that generates an attraction force to act in an advancing direction when the plunger rod approaches a most advanced position thereof.

According to a second invention, in the first invention, the magnetic field generating mechanism is constituted by a magnetic member disposed on the plunger rod, and a solenoid disposed to face the magnetic member, and the controller energizes the solenoid to generate a magnetic field when the plunger rod is operated to advance.

According to a third invention, in the second invention, the controller energizes the solenoid in a time zone that includes a period spanning from start of an advance operation of the plunger rod to end of the advance operation of the plunger rod.

According to a fourth invention, in the second or third invention, the solenoid includes a recess that allows the magnetic member to come into the recess, and that acts as a guide for movement of the magnetic member.

According to a fifth invention, in any one of the second to fourth inventions, the droplet forming device further comprises an adjustment mechanism that adjusts a fixed position of the magnetic member or the solenoid, wherein the most advanced position of the plunger rod is specified by abutment between the magnetic member and the solenoid.

According to a sixth invention, in any one of the first to fifth inventions, the droplet forming device further comprises a selector valve that controls a flow rate of the pressurized gas flowing into the pressurization chamber and a flow rate of the pressurized gas flowing out from the pressurization chamber.

According to a seventh invention, there is provided a droplet forming method using a droplet forming device for discharging a droplet in a flying fashion from a nozzle, the device comprising a liquid chamber that is communicated with the nozzle and is supplied with a liquid material, a plunger rod having a tip that is moved to advance and retreat within the liquid chamber, a spring that applies a biasing force to the plunger rod, a pressurization chamber that is supplied with a pressurized gas acting to retreat the plunger rod, a pressure source that supplies the pressurized gas to the pressurization chamber, and a controller, wherein the droplet forming device further comprises a magnetic field generating mechanism that generates an attraction force to act in an advancing direction when the plunger rod approaches a most advanced position thereof, and wherein the droplet forming method comprises a filling step of supplying the pressurized gas to flow into the pressurization chamber, to thereby retreat the plunger rod, and supplying the liquid material to flow into the liquid chamber, and a discharging step of releasing the pressurized gas in the pressurization chamber to advance the plunger rod, and generating the attraction force by the magnetic field generating mechanism to act in the advancing direction of the plunger rod, thereby discharging the liquid material in the liquid chamber.

According to an eighth invention, in the seventh invention, the magnetic field generating mechanism is constituted by a magnetic member disposed on the plunger rod, and a solenoid disposed to face the magnetic member, and in the discharging step, the controller energizes the solenoid to generate a magnetic field when the plunger rod is operated to advance.

According to a ninth invention, in the eighth invention, the controller energizes the solenoid in a time zone that includes a period spanning from start of an advance operation of the plunger rod to end of the advance operation of the plunger rod.

According to a tenth invention, in the eighth or ninth invention, the solenoid includes a recess that allows the magnetic member to come into the recess, and that acts as a guide for movement of the magnetic member, and in the discharging step, the magnetic member comes into the solenoid while being guided by the recess.

According to an eleventh invention, in any one of the eighth to tenth inventions, the droplet forming device further comprises an adjustment mechanism that adjusts a fixed position of the magnetic member or the solenoid, wherein in the discharging step, the most advanced position of the plunger rod is specified by abutment between the magnetic member and the solenoid.

According to a twelfth invention, in any one of the seventh to eleventh inventions, the droplet forming device further comprises a selector valve that controls a flow rate of the pressurized gas flowing into the pressurization chamber and a flow rate of the pressurized gas flowing out from the pressurization chamber, wherein in the filling step, the selector valve is brought into a first position at which the pressurized gas flows into the pressurization chamber, and in the discharging step, the selector valve is brought into a second position at which the pressurized gas flows out from the pressurization chamber.

Advantageous Effects of the Invention

With the present invention, the following advantageous effects can be obtained in comparison with the prior art.

First, since the biasing force of the spring and a propulsion force of the magnetic field generating mechanism are utilized in a combined manner, a strong advancing force can be exerted on the valve body (plunger rod) in a short time. Therefore, the droplets of the liquid material can be precisely controlled without increasing the device size. Furthermore, even a liquid material with high viscosity, which has been so far difficult to be discharged in the form of a droplet, can be discharged as a flying droplet.

Secondly, since a compression characteristic of the spring is not changed in spite of intensification of the biasing force applied to the valve body (plunger rod), an advance time of the valve body is shortened. As a result, a tact time can also be shortened.

Thirdly, the intensification of the advancing force of the valve body (plunger rod) can be simply realized by improving a known air spring type device.

BRIEF DESCRIPTION OF THE DRAWINGS

FIG. 1 is an explanatory view of a droplet forming device according to the present invention when a valve body is ascended.

FIG. 2 is an explanatory view of the droplet forming device according to the present invention when a valve body is descended.

FIG. 3 is a chart depicting the relation between operation timing and a tip position of a valve body in the droplet forming device according to the present invention. Specifically, FIG. 3(*a*) represents a signal supplied to a selector valve, FIG. 3(*b*) represents a signal supplied to a solenoid, and FIG. 3(*c*) represents the tip position of the valve body.

FIG. 4 is a schematic perspective view of an applying device according to Example 1.

FIG. 5 is an explanatory view illustrating the case when the valve body is not abutted against a valve seat in a droplet forming device according to Example 2. Specifically, FIG.

5(*a*) represents the case of adjusting the position of a core member, and FIG. 5(*b*) represents the case of adjusting the position of a solenoid.

FIG. 6 is a chart depicting the relation between operation timing and a tip position of a valve body in an air spring type device of prior art. Specifically, FIG. 6(*a*) represents a signal supplied to a selector valve, and FIG. 6(*b*) represents the tip position of the valve body.

FIG. 7 is a chart depicting the relation between operation timing and a tip position of a valve body in a solenoid type device of prior art. Specifically, FIG. 7(*a*) represents a signal supplied to a first solenoid, FIG. 7(*b*) represents a signal supplied to a second solenoid, and FIG. 7(*c*) represents the tip position of the valve body.

MODE FOR CARRYING OUT THE INVENTION

One example of the mode for carrying out the present invention will be described below. In the following, for convenience of explanation, a direction in which droplets are discharged is called a "downward direction", and a direction opposing to the droplet discharge direction is called an "upward direction". In relation to the operation, movement in the upward direction is called an "ascent", and movement in the downward direction is called a "descent".

[Device]

FIGS. 1 and 2 schematically illustrate the droplet forming device according to the present invention. FIG. 1 is an explanatory view of the droplet forming device when a valve body is ascended, and FIG. 2 is an explanatory view of the droplet forming device when the valve body is descended.

A droplet forming device 1 according to the present invention includes, as main components, a main body 2 including, e.g., a driving chamber in which a valve body (plunger rod) 6 is driven to move in the up-and-down direction, the plunger rod 6 disposed inside the main body 2, and a discharge unit 3 for ejecting a liquid material 37 by the action of the driven plunger rod 6.

The driving chamber defined in the main body 2 is constituted by a first driving chamber 4 for ascent driving, and a second driving chamber 5 for descent driving.

The first driving chamber 4 is a space in which a piston 7 fixed to the plunger rod 6 is disposed slidably in the up-and-down direction. The first driving chamber 4 is partitioned by the piston 7 into a spring chamber 9 and an air chamber 11. The spring chamber 9 is formed at the upper side of the piston 7, and it accommodates a spring 8 for driving the plunger rod 6 to descend. The air chamber (pressurization chamber) 11 is formed at the lower side of the piston 7 and is supplied with compressed air 10 for driving the plunger rod 6 to ascend. A compression coil spring is used as the spring 8. As stroke adjustment screw 12 for restricting movement of the plunger rod 6 and adjusting a distance through which the plunger rod 6 is moved, i.e., a stroke, is disposed in an upper portion of the spring chamber 9. The stroke of the plunger rod 6 is adjusted by turning an externally-exposed thumb portion 13 of the adjustment screw 12 to move a tip 14 of the adjustment screw in the up-and-down direction, thus changing a distance through which an upper end of the plunger rod 6 is allowed to move until striking against the adjustment screw 12.

The compressed air 10 supplied to the air chamber 11 flows into the air chamber 11 through an air inlet 17 of the first driving chamber 4 from a compressed air source (pressurization source) 15 via a selector valve 16. The selector valve 16 is constituted as a solenoid valve or a rapid response valve, and opening and closing of the selector valve 16 is controlled by a dispense controller 45 (described later). A regulator 18 for adjusting pressure is disposed between the compressed air source 15 and the selector valve 16. A sealing member 19 is disposed in a lateral surface of the piston 7, and a sealing member 20 is disposed in a lower portion of the air chamber 11 through which the plunger rod 6 penetrates, thereby preventing leakage of the compressed air 10 supplied to the air chamber 11.

The second driving chamber 5 is a space through which the plunger rod 6 penetrates in the up-and-down direction. A solenoid 21 having a bore 28 through which the plunger rod 6 penetrates is fixed to a lower portion of the second driving chamber 5. The solenoid 21 includes, on its upper surface, a recess 23 to which a core member 22 made of a magnetic material can be fitted. The solenoid 21 cooperates with the core member 22 to function as a magnetic field generating mechanism for generating an attraction force to act in the advancing direction of the plunger rod 6. Furthermore, the recess 23 functions as a guide for both the core member 22 and the plunger rod 6, thus reducing a deviation of a center axis and ensuring that the plunger rod 6 straightly abuts against a valve seat 31. The plunger rod 6 is made of a nonmagnetic material.

The core member 22 is a magnetic member made of cast steel or structural carbon steel, for example, such that the core member 22 is attracted toward the solenoid 21 when the solenoid 21 is magnetized. The core member 22 is attached to the plunger rod 6. A flange portion 24 is formed at an upper end of the core member 22. In this embodiment, however, because a tip 34 of the plunger rod abuts against the valve seat 31 at earlier timing, the flange portion 24 is not contacted with an upper surface 25 of the solenoid, and a lower surface 26 of the core member is not contacted with a bottom surface 27 of the solenoid recess, respectively. Thus, a small clearance exists between the flange portion 24 and the upper surface 25 of the solenoid.

In another embodiment, the flange portion 24 may be contacted with the upper surface 25 of the solenoid and/or the lower surface 26 of the core member may be contacted with the bottom surface 27 of the solenoid recess, to thereby prevent the plunger rod 6 from descending beyond a setting stroke. In such an embodiment, the liquid material is discharged in a state where the rod tip 34 does not abut against the valve seat 31.

The discharge unit 3 includes a liquid chamber 29 in which the plunger rod 6 is movable up and down. A hole 30 through which the plunger rod 6 penetrates is formed in an upper portion of the discharge unit 3. The valve seat 31 and a nozzle 32 through which the liquid material 37 is discharged are attached to a lower portion of the discharge unit 3, the lower portion having a cylindrical shape projecting downward. A communication hole 35 for communicating the liquid chamber 29 and the nozzle 32 with each other is formed to penetrate through a central portion of the valve seat 31. An upper surface of the valve seat 31 is partly formed as a conical surface 33. The liquid material 37 is discharged through the nozzle 32 upon the communication hole 35 being opened and closed with movement of the rod tip 34 departing from and abutting against the conical surface 33. A tubular member 36 communicating with the communication hole 35 in the valve seat 31 penetrates through the nozzle 32 such that the liquid material 37 flowing from the liquid chamber 29 through the communication hole 35 in the valve seat is discharged to the outside after passing through the tubular member 36. The valve seat 31 and the nozzle 32 are detachably fixed to a lower end of the liquid chamber 29 by a cap-like member 38 for easy replacement. An introducing passage 40 supplied with the liquid material 37, which is stored in a reservoir 39, is formed to extend from a lateral surface of the liquid chamber 29. The introducing passage 40 has one end communicating with the liquid chamber 29, and the other end connected to the reservoir 39 through an extension member 42 that includes a communication flow passage 41 formed therein. The reservoir 39 is supplied with compressed gas from a compressed gas source 43, and pressure of the compressed gas source 43 can be adjusted by the dispense controller 45 (described later). A sealing member 44 is fitted into the hole in the upper portion of the liquid chamber 29, through which the plunger rod 6 penetrates, such that the liquid material 37 is not leaked to the side including the second driving chamber 5.

The dispense controller 45 for managing and controlling ON/OFF of the selector valve 16 and the solenoid 21, the pressure of the compressed gas source 43, etc. is connected to the above-described individual components and units via signal lines (46, 47) and pneumatic pipes (48, 49). The dispense controller 45 is disposed separately from the droplet forming device 1.

The above-described configuration of the present invention can be readily realized by improving the air spring type device of prior art. More specifically, the present invention can be practiced just by adding the magnetic field generating mechanism (solenoid), which exerts the propulsion force on the plunger rod, without changing the spring and so on. Therefore, the known device can be improved at a low cost, and an increase of the device size can be avoided.

[Operation]

The operation of the droplet forming device according to the present invention will be described below in comparison with the operations of the known devices. First, the operations of the known devices are described in (1) and (2). Then, the operation of the present invention is described in (3). It is to be noted that, in each of charts described below, the horizontal axis represents a time (t), and the vertical axis represents a voltage (V) in the case of a signal and a position (St) from the valve seat in the case of considering a tip of the valve body.

(1) Air Spring Type Device of Prior Art

FIG. 6 is a chart representing the relation between operation timing and a tip position of a valve body in the air spring type device of prior art (e.g., Patent Document 1). Specifically, FIG. 6(*a*) represents a signal supplied to a selector valve, and FIG. 6(*b*) represents the tip position of the valve body.

In the air spring type device of prior art, when an operation start signal is sent to the selector valve (turned ON), the selector valve is switched over such that the compressed air flows into the air chamber to raise (retreat) the piston while compressing the spring, whereupon the plunger rod 6 opens the discharge port (denoted by symbol 50). When the spring is compressed, it requires a greater force to further compress itself. Thus, as denoted by the symbol 50 in a characteristic curve, a stroke change is moderated near the end of retreat operation. When the operation signal sent to the selector valve is changed over (turned OFF) after the lapse of a setting time (denoted by symbol 51), the selector valve is switched over such that the compressed air in the air chamber starts to be released to the atmosphere and the piston is descended by the repulsive force of the spring, whereupon the plunger rod 6 closes the discharge port (denoted by symbol 52). In response to the closing of the discharge port, the liquid material is discharged in the form of a droplet. In the descent (advance) of the piston, the characteristic curve declines as denoted by symbol 52 for the reason as follows. When the piston starts to descend, the repulsive force of the spring is strong and a descending speed of the piston is fast. However, when the piston approaches the end of the descent stroke, the spring comes into an extended state, thus resulting in that the repulsive force is weakened and the descending speed is slowed. One cycle of discharge in the air spring type device of prior art is performed through a series of the operations described above.

When the spring is intensified to obtain a stronger biasing force, the characteristic curve denoted by symbol 50 becomes more moderate.

(2) Solenoid Type Device of Prior Art

FIG. 7 is a chart representing the relation between operation timing and a tip position of a valve body in a known droplet forming device using DC solenoids. Specifically, FIG. 7(*a*) represents a signal supplied to a first solenoid, FIG. 7(*b*) represents a signal supplied to a second solenoid, and FIG. 7(*c*) represents the tip position of the valve body.

In the solenoid type device of prior art, when an operation start signal is sent to the first solenoid (turned ON), the first solenoid is magnetized to move the core rod, whereupon the jetting member opens the nozzle (denoted by symbol 53). When the operation signal sent to the first solenoid is cut off (turned OFF) and an operation start signal is sent to the second solenoid (turned ON) after the lapse of a setting time (denoted by symbol 54), the second solenoid moves the core rod, whereupon the jetting member closes the nozzle (denoted by symbol 55). In response to the closing of the nozzle, the liquid material (e.g., an adhesive) is discharged in the form of a droplet. One cycle of discharge in the solenoid type device of prior art is performed through a series of the operations described above.

(3) Device of Present Invention

On the basis of the above description of the two known devices, the operation of the droplet forming device according to the present invention will be described below. FIG. 3 is a chart representing the relation between operation timing and the tip position of the valve body in the droplet forming device according to the present invention. Specifically, FIG. 3(*a*) represents a signal supplied to the selector valve, FIG. 3(*b*) represents a signal supplied to the solenoid, and FIG. 3(*c*) represents the tip position of the valve body.

First, the compressed air 10 is supplied to flow into the air chamber 11 to retreat the plunger rod 6. In more detail, when an operation start signal is sent to the selector valve 16 (turned ON), the selector valve is switched over such that the compressed air 10 flows into the air chamber 11 to raise the piston 7 while compressing the spring 8, whereupon the plunger rod 6 opens the communication hole 35 in the valve seat and further opens the nozzle 32 communicating with the communication hole 35 (denoted by symbol 56, see FIG. 1 as well). At that time, power supply to the solenoid 21 is stopped, and no attraction force (suction force) acts on the core member 22.

After the lapse of a setting time (denoted by symbol 57), the plunger rod 6 is advanced. In more detail, when the operation signal sent to the selector valve 16 is cut off (turned OFF) and an operation start signal is sent to the solenoid 21 (turned ON), the selector valve is switched over such that the compressed air 10 in the air chamber 11 starts to be released to the atmosphere and the descent of the piston 7 is started by the repulsive force of the spring 8. Here, as the piston 7 descends, the repulsive force of the spring 8 gradually weakens. Conversely, the attraction force generated by the solenoid 21 gradually increases. In other words, due to the property that an attraction force between a magnetic body and a magnet increases as a gap between them reduces, the force generated by the magnetized solenoid 21 and acting to attract the core member 22, which is attached to the plunger rod 6, gradually increases. As a result, the propulsion force can be continuously exerted on the plunger rod from the start of descent of the plunger rod to the end of the descent without being attenuated. Then, the plunger rod 6 abuts against the valve seat 31 and closes the nozzle 32 (denoted by symbol 58, see FIG. 2 as well). Thus, since the communication hole 35 is closed by exerting the stable propulsion force on the plunger rod 6, a droplet of the liquid material 37, formed in the discharge process, can be controlled precisely. One cycle of discharge in the device of the present invention is performed through a series of the operations described above.

In the present invention, since the spring is not intensified and the piston 7 is raised only by the force of the compressed air 10, the plunger rod 6 can be ascended in a short time (denoted by symbol 59). On the other hand, when the plunger rod 6 is descended, a strong propulsion force can be obtained in a sharply rising time with the strong repulsive force of the spring 8 at the beginning of the descent (denoted by symbol 60). Thereafter, as the descent operation approaches the end, the attraction force generated by the solenoid 21 is increased and added to the force of the spring 8. As a result, the plunger rod 6 abuts against the valve seat 31 more strongly at a higher speed than in the case of utilizing only the force of the spring as denoted by symbol 52 in FIG. 6, whereby the liquid material is discharged (denoted by symbols 61 and 62).

According to the present invention, as described above, a stronger force can be exerted on the valve body in a shorter time by utilizing the force of the spring and the force of the solenoid at appropriate timing in the descent operation of the valve body. Hence, for various types of liquid materials ranging from high viscosity to low viscosity, it is possible to form droplets that are precisely controlled, and to discharge the droplets in a flying fashion.

Moreover, in the ascent operation of the valve body, since the spring is not intensified and the piston 7 is raised only by the force of the compressed air 10, the valve body can be ascended in a shorter time, and a tact time in the continuous discharge operation can be shortened. The present invention is suitable for continuous high-speed discharge (e.g., 100 shots or more per second).

Details of the present invention will be described below in connection with Examples. However, it is to be noted that the present invention is in no way restricted by the following Examples.

Example 1

Applying Apparatus

An applying apparatus 63 can be constituted by mounting the droplet forming device 1, according to the present invention, to a driving mechanism 64. FIG. 4 illustrates one example of the applying apparatus 63.

The driving mechanism 64 is constituted by an X driving mechanism 65 capable of effectuating movement in a direction denoted by symbol 68, Y driving mechanism 66 capable of effectuating movement in a direction denoted by symbol 69, and a Z driving mechanism 67 capable of effectuating movement in a direction denoted by symbol 70. A robot controller 71 for controlling operations of those mechanisms is included inside a housing. The robot controller 71 is connected to the dispense controller 45 by a cable 72 and sends operation signals to the dispense controller 45. Furthermore, the robot controller 71 includes a memory that stores routine application programs in relation to the XYZ movement operations, the discharge operation timing, etc. The droplet forming device 1 is supported by a holder 73 disposed on the Z driving mechanism 67, and the Z driving mechanism 67 is disposed on the X driving mechanism 65. A work table 75 on which an application target 74 is fixedly placed is disposed on the Y driving mechanism 66. With such an arrangement, the nozzle 32 of the droplet forming device 1 can be moved in XYZ directions (68, 69, 70) relative to the application target 74. The droplet forming device 1 is constituted as per described above with reference to FIGS. 1 and 2, and description of the droplet forming device 1 is omitted here.

The droplet forming device 1 is connected to the dispense controller 45 that is separately disposed to manage and control ON/OFF of the selector valve 16 and the solenoid 21, the pressure of the compressed gas source 43, etc. For clearer appearance of the drawing, regarding the connection between the droplet forming device 1 and the controller 45, respective portions (of the signal lines) denoted by symbols 46 and 47 and (of the pneumatic pipe) denoted by symbol 48, which extend further from a wavy line, are omitted. Details of the connections of the signal lines, the pneumatic pipes, etc. are as per described above with reference to FIGS. 1 and 2, and description of those connection is omitted here. The selector valve 16 is connected to the compressed air source 15, not illustrated in FIG. 4, via the regulator 18.

Basic operating procedures of the applying apparatus 63 will be described below.

First, as preparatory setup, (1) the droplet forming device 1 is mounted and fixed to the holder 73 of the Z driving mechanism 67, and the lines (46, 47) and the pipes (48, 49) are connected. Furthermore, (2) the routine application programs in relation to the XYZ movement operations, the discharge operation timing, etc. are prepared and stored in the robot controller 71. After the preparatory setup, (3) the application target 74 is placed on and fixed to the work table 75. Then, (4) the stored application programs are executed to perform application work. When the application work is successively performed on a plurality of application targets 74, the above (3) and (4) are repeated. The intended work can be readily changed by varying the application programs in the above (2) depending on the desired application form.

A basic operation flow of the droplet forming device 1 and the applying apparatus 63 is as per described above. The desired discharge can be performed on a precise position by employing the applying apparatus constituted as described above. It is also possible to automate the application work.

Example 2

The droplet forming device 1 according to Example 1 basically operates such that the droplets are formed by abutting the valve body (plunger rod) 6 against the valve seat 31. In the case of liquid materials containing solid particles (such as a solder paste and a phosphor paste), however, the abutment of the selector valve against the valve seat may cause the problem that the particles are collapsed and quality of a material is degraded, or that the nozzle is clogged with the material. Aiming to solve the above-mentioned problem, it is preferable to perform the discharge without abutting the valve body 6 against the valve seat 31. From that point of view, a droplet forming device 1 according to Example 2, illustrated in FIG. 5, is constituted such that the discharge is performed without abutting the valve body 6 against the valve seat 31. In FIG. 5, the selector valve 16, the reservoir 39, etc. are omitted.

In the droplet forming device 1 according to Example 2, the valve body 6 is prevented from being abutted against the valve seat 31 at a most advanced position of the valve body 6 by making the flange portion 24 of the core member 22 in the second driving chamber 5 abutted against the upper surface 25 of the solenoid 21. FIG. 5(*a*) represents the configuration for adjusting the position of the core member 22, and FIG. 5(*b*) represents the configuration for adjusting the position of the solenoid 21. In the configuration of FIG. 5(*a*), the core member 22 is fixed in a state where it is moved downward by a distance corresponding to a spacing (denoted by symbol CL) between the rod tip 34 and the valve seat. In the configuration of FIG. 5(*b*), the solenoid 21 is fixed in a state where it is moved upward by the distance corresponding to the spacing (denoted by symbol CL) between the rod tip 34 and the valve seat. The spacing between the rod tip 34 and the valve seat is selected as appropriate depending on conditions such as the type of liquid material, an amount of the liquid material discharged by one shot. That spacing is desirably determined in advance, for example, by carrying out experiments, etc. Here, as described above, there is a small clearance between the core member 22 and the solenoid 21. It is hence to be noted that the above-mentioned adjustment movement of the core member 22 or the solenoid 21 is performed in consideration of such a small clearance. A mechanism for adjusting the solenoid 21 or the core member 22 may be a screw mechanism capable of determining a movement distance from an angle through which a screw has been rotated, or a mechanism of inserting a spacer of which thickness is known in advance. By employing such a mechanism, the adjustment can be performed in a quantitative manner.

INDUSTRIAL APPLICABILITY

The present invention can be applied to production processes for electric and electronic components, and can also be employed to discharge, e.g., food materials, medical and pharmaceutical materials, and biological materials for which appropriate temperatures are determined and temperature control to reduce viscosity cannot be performed arbitrarily.

LIST OF REFERENCE SYMBOLS

1: droplet forming device 2: main body 3: discharge unit 4: first driving chamber 5: second driving chamber 6: valve body (plunger rod) 7: piston 8: spring 9: spring chamber 10: compressed air 11: air chamber (pressurization chamber) 12: stroke adjustment screw 13: thumb portion 14: tip of adjustment screw 15: compressed air source 16: selector valve 17: air inlet 18: regulator 19: sealing member (for piston) 20: sealing member (for air chamber) 21: solenoid 22: core member 23: recess 24: flange portion 25: upper surface of solenoid 26: lower surface of core member 27: bottom surface of recess 28: penetration bore (in solenoid) 29: liquid chamber 30: penetration hole (in liquid chamber) 31: valve seat 32: nozzle 33: conical surface 34: rod tip 35: communication hole 36: tubular member 37: liquid material 38: cap-like member 39: reservoir 40: introducing passage 41: communication flow passage 42: extension member 43: compressed gas source 44: sealing member (for liquid chamber) 45: dispense controller 46: signal line 47: signal line 48: pneumatic pipe 49: pneumatic pipe 50: piston ascent (FIG. 6) 51: piston stop (FIG. 6) 52: piston descent (FIG. 6) 53: piston ascent (FIG. 7) 54: piston stop (FIG. 7) 55: piston descent (FIG. 7) 56: piston ascent (FIG. 3) 57: piston stop (FIG. 3) 58: piston descent (FIG. 3) 59: start of piston ascent (FIG. 3) 60: start of piston descent (FIG. 3) 61: end of piston descent (FIG. 3) 62: cut time (FIG. 3) 63: applying apparatus 64: driving mechanism 65: X driving mechanism 66: Y driving mechanism 67: Z driving mechanism 68: X moving direction 69: Y moving direction 70: Z moving direction 71: robot controller 72: cable 73: holder 74: application target 75: work table CL: clearance

The invention claimed is:

1. A droplet forming device for discharging a droplet in a flying fashion from a discharge port, the device comprising:

a liquid chamber that is communicated with the discharge port and is supplied with a liquid material;

a valve seat having a communication hole for communicating the liquid chamber and the discharge port;

a plunger rod having a tip that is moved to advance and retreat within the liquid chamber;

a spring that biases the plunger rod in an advancing direction;

a pressurization chamber that is supplied with a pressurized gas acting to retreat the plunger rod;

a pressure source that supplies the pressurized gas to the pressurization chamber;

a controller; and a magnetic field generating mechanism that generates a magnetic attraction force to act in the advancing direction when the plunger rod approaches a most advanced position thereof, wherein the device does not include a spring that biases the plunger rod in a retreating direction, wherein the magnetic field generating mechanism is constituted by a magnetic member disposed on the plunger rod, and a solenoid disposed to face the magnetic member, in a vertical direction along an axis of the plunger rod, and wherein the controller energizes the solenoid to generate the magnetic attraction force when the plunger rod is operated to advance toward the valve seat, thereby transferring an advancing force to the liquid material so as to discharge the liquid material in a droplet state, and wherein the controller stops power supply to the solenoid when the plunger rod is operated to retreat.

2. The droplet forming device according to claim 1, wherein the controller energizes the solenoid in a time zone that includes a period spanning from start of an advance operation of the plunger rod to end of the advance operation of the plunger rod.

3. The droplet forming device according to claim 2, wherein the solenoid includes a recess that allows the magnetic member to come into the recess when the plunger rod advances in the advancing direction, and that acts as a guide for movement of the magnetic member.

4. The droplet forming device according to claim 2, further comprising a selector valve that controls a flow rate of the pressurized gas flowing into the pressurization chamber and a flow rate of the pressurized gas flowing out from the pressurization chamber.

5. The droplet forming device according to claim 2, further comprising a height adjustment mechanism that adjusts a fixed position of the magnetic member or the solenoid, wherein the most advanced position of the plunger rod is specified by abutment between the magnetic member and the solenoid.

6. The droplet forming device according to claim 2, further comprising a height adjustment mechanism that adjusts a fixed position of the solenoid, wherein the height adjustment mechanism comprises a spacer arranged below the solenoid, and wherein the most advanced position of the plunger rod is specified by abutment between the magnetic member and the solenoid.

7. The droplet forming device according to claim 1, wherein the solenoid includes a recess that allows the magnetic member to come into the recess when the plunger rod advances in the advancing direction, and that acts as a guide for movement of the magnetic member.

8. The droplet forming device according to claim 1, further comprising a selector valve that controls a flow rate of the pressurized gas flowing into the pressurization chamber and a flow rate of the pressurized gas flowing out from the pressurization chamber.

9. The droplet forming device according to claim 1, further comprising a height adjustment mechanism that adjusts a fixed position of the magnetic member or the solenoid, wherein the most advanced position of the plunger rod is specified by abutment between the magnetic member and the solenoid.

10. The droplet forming device according to claim 1, further comprising a height adjustment mechanism that adjusts a fixed position of the solenoid, wherein the height adjustment mechanism comprises a spacer arranged below the solenoid, and wherein the most advanced position of the plunger rod is specified by abutment between the magnetic member and the solenoid.

11. A droplet forming method using a droplet forming device for discharging a droplet in a flying fashion from a discharge port, comprising:

a filling step of supplying a pressurized gas to flow into a pressurization chamber of the droplet forming device, to thereby retreat a plunger rod of the droplet forming device, and supplying a liquid material to flow into a liquid chamber of the droplet forming device; and a discharging step of releasing the pressurized gas in the pressurization chamber to advance the plunger rod toward the valve seat, and generating a magnetic attraction force by a magnetic field generating mechanism of the droplet forming device to act in an advancing direction of the plunger rod, thereby transferring an advancing force to the liquid material so as to discharge the liquid material in a droplet state, wherein the droplet forming device comprises the liquid chamber that is communicated with the discharge port and is supplied with a liquid material;

the valve seat having a communication hole for communicating the liquid chamber and the discharge portion;

the plunger rod having a tip that is moved to advance and retreat within the liquid chamber;

a spring that biases the plunger rod in the advancing direction;

a pressurization chamber that is supplied with a pressurized gas acting to retreat the plunger rod;

a pressure source that supplies the pressurized gas to the pressurization chamber;

a controller, and the magnetic field generating mechanism that generates the magnetic attraction force to act in the advancing direction when the plunger rod approaches a most advanced position thereof, wherein the droplet forming device does not include a spring that biases the plunger rod in a retreating direction, wherein the magnetic field generating mechanism is constituted by a magnetic member disposed on the plunger rod, and a solenoid disposed to face the magnetic member, in a vertical direction along an axis of the plunger rod, wherein, in the discharging step, the controller energizes the solenoid to generate the magnetic attraction force when the plunger rod is operated to advance, and wherein, in the filling step, the controller stops power supply to the solenoid when the plunger rod is operated to retreat.

12. The droplet forming method according to claim 11, wherein the controller energizes the solenoid in a time zone that includes a period spanning from start of an advance operation of the plunger rod to end of the advance operation of the plunger rod.

13. The droplet forming method according to claim 12, wherein the solenoid includes a recess that allows the magnetic member to come into the recess when the plunger rod advances in the advancing direction, and that acts as a guide for movement of the magnetic member, and in the discharging step, the magnetic member comes into the solenoid while being guided by the recess.

14. The droplet forming method according to claim 12, wherein the droplet forming device further comprises a selector valve that controls a flow rate of the pressurized gas flowing into the pressurization chamber and a flow rate of the pressurized gas flowing out from the pressurization chamber, and wherein in the filling step, the selector valve is brought into a first position at which the pressurized gas flows into the pressurization chamber, and in the discharging step, the selector valve is brought into a second position at which the pressurized gas flows out from the pressurization chamber.

15. The droplet forming method according to claim 12, wherein the droplet forming device further comprises a height adjustment mechanism that adjusts a fixed position of the magnetic member or the solenoid, wherein the most advanced position of the plunger rod is specified by abutment between the magnetic member and the solenoid.

16. The droplet forming method according to claim 12, wherein the droplet forming device further comprises a height adjustment mechanism that adjusts a fixed position of the solenoid, wherein the height adjustment mechanism comprises a spacer arranged below the solenoid, and wherein the most advanced position of the plunger rod is specified by abutment between the magnetic member and the solenoid.

17. The droplet forming method according to claim 11, wherein the solenoid includes a recess that allows the magnetic member to come into the recess when the plunger rod advances in the advancing direction, and that acts as a guide for movement of the magnetic member, and in the discharging step, the magnetic member comes into the solenoid while being guided by the recess.

18. The droplet forming method according to claim 11, wherein the droplet forming device further comprises a selector valve that controls a flow rate of the pressurized gas flowing into the pressurization chamber and a flow rate of the pressurized gas flowing out from the pressurization chamber, and wherein in the filling step, the selector valve is brought into a first position at which the pressurized gas flows into the pressurization chamber, and in the discharging step, the selector valve is brought into a second position at which the pressurized gas flows out from the pressurization chamber.

19. The droplet forming method according to claim 11, wherein the droplet forming device further comprises a height adjustment mechanism that adjusts a fixed position of the magnetic member or the solenoid, wherein the most advanced position of the plunger rod is specified by abutment between the magnetic member and the solenoid.

20. The droplet forming method according to claim 11, wherein the droplet forming device further comprises a height adjustment mechanism that adjusts a fixed position of the solenoid, wherein the height adjustment mechanism comprises a spacer arranged below the solenoid, and wherein the most advanced position of the plunger rod is specified by abutment between the magnetic member and the solenoid.

* * * * *